US006750599B2

(12) United States Patent
Tajima

(10) Patent No.: US 6,750,599 B2
(45) Date of Patent: Jun. 15, 2004

(54) IMAGE DISPLAY DEVICE AND METHOD OF MANUFACTURING THE SAME

(75) Inventor: Hisao Tajima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/298,007

(22) Filed: Nov. 18, 2002

(65) Prior Publication Data

US 2003/0098642 A1 May 29, 2003

(30) Foreign Application Priority Data

Nov. 27, 2001 (JP) ..... 2001-360886
Nov. 8, 2002 (JP) ..... 2002-325140

(51) Int. Cl.[7] ..... H01J 1/88
(52) U.S. Cl. ..... 313/292; 313/495
(58) Field of Search ..... 313/292, 495, 313/583, 512

(56) References Cited

U.S. PATENT DOCUMENTS 6,169,356 B1 1/2001 Ohnishi et al. ..... 313/495
6,344,711 B1 2/2002 Ohnishi et al. ..... 313/495
6,384,541 B1 5/2002 Ohnishi et al. ..... 315/169.3
2002/0021081 A1 2/2002 Tajima et al. ..... 313/495

FOREIGN PATENT DOCUMENTS

JP 5-34713 2/1993
JP 7-235255 5/1995
JP 8-138560 5/1996

*Primary Examiner*—Vip Patel
(74) *Attorney, Agent, or Firm*—Fitzpatrick, Cella, Harper & Scinto

(57) ABSTRACT

This application discloses an image display device. In particular, this application discloses a structure of an image display device that includes a rear member placed in the rear of a display panel and a drive circuit placed on the rear side of the rear member, in which the rear member has in a part thereof a part having a shape bent to the display panel side, the display panel and the drive circuit are connected by wiring passing through an opening that is placed adjacent to the part having the bent shape, and positional deviation of the display panel is regulated by the part having the bent shape.

35 Claims, 6 Drawing Sheets

IMAGE DISPLAY DEVICE AND METHOD OF MANUFACTURING THE SAME

BACKGROUND OF THE INVENTION

1. Field of the Invention

The present invention relates to an image display device and a method of manufacturing the same.

2. Related Background Art

Thin flat image display devices such as a display device using electron-emitting devices, a display device using plasma discharge, a display device using liquid crystal, and a display device using a fluorescent display tube are used for applications such as televisions, computer terminals, advertisement media and signs. Moreover, in recent years, a wall-mounted television with a screen size of 40 inches or more, which makes good use of characteristics of a thin image display device, is attracting attentions. A basic structure of these image display devices consists of an image display unit, an electric circuit unit, a structure portion supporting them, and an armor portion.

As a conventional thin flat image display device, for example, a display device using plasma discharge is known.

In the display device using plasma discharge, there is known a structure in which a vacuum container constituting a display panel for displaying an image is stuck to a frame using a double-faced tape. Further, as a prior art relating to a display device, structures described in Japanese Patent Application Laid-Open No. 8-138560 and Japanese Patent Application Laid-Open No. 5-34713 are known.

SUMMARY OF THE INVENTION

The inventors have devoted themselves to examination of a supporting structure in an image display device and obtained the invention described below. That is, an image display device is provided, which includes:

a display panel for displaying an image;

a rear member that is located in the rear of the display panel; and a drive circuit that is located on the rear side of the rear member, in which the rear member has in a part thereof a part having a shape bent to the display panel side, the display panel and the drive circuit are connected by wiring passing through an opening that is located adjacent to the part having the bent shape, and positional deviation of the display panel is regulated by the part having the bent shape.

Here, a structure in which the part having the bent shape is provided in a part of an end of the rear member can be preferably adopted.

In addition, a structure in which the bent shape is a shape formed by bending can be preferably adopted. Here, the bending is processing with which a part of a shape which is less bent than the bent shape (including an unbent shape) bends. For example, pressing can be preferably adopted as the bending described herein.

Note that it is particularly preferable to adopt a plate-like member as the rear member described above.

In addition, a rear member of metal can be particularly preferably adopted.

In addition, a structure in which a part to be the opening is simultaneously formed by forming the part having the bent shape can be preferably adopted. More specifically, it is sufficient to cause wiring to pass through an opening that is constituted in a notch shape or a hole shape that is simultaneously formed when the bent shape is formed. In this case, a structure can be preferably adopted in which a part of a shape equivalent to the notch shape or the hole shape is bent to the display panel side and becomes the part having the bent shape.

Further, a structure can be preferably adopted in which peripheral members located in the periphery of the rear member are provided and the rear member is coupled with the peripheral members in parts other than the part having the bent shape. More specifically, a structure can be preferably adopted in which the part having the bent shape is provided in a part of an end of the rear member and the peripheral members and the rear member are coupled in parts having a shape which is less bent than the bent shape, which is present in parts other than the part of the end of the rear member. In this case, a part nipped by the part having the bent shape and the peripheral members can be used as the opening.

Note that the coupling can be preferably realized by screws.

In addition, in the invention pertaining to this application, "a position of the display panel is regulated by the part having the bent shape" indicates that positional deviation of the display panel of a predetermined amount or more is regulated by the part having the bent shape. This corresponds to, for example, a state in which the display panel is prevented from causing positional deviation (positioned) by an end thereof being in direct or indirect contact with the part having the bent shape or a state in which, although the end of the display panel is not in direct or indirect contact with the part having the bent shape, if positional deviation should occur in future, the part having the bent shape is present in a position for regulating the display panel not to cause further positional deviation by the end of the display panel coming into contact with the part having the bent shape directly or indirectly. Further, as a structure with a plurality of parts having the bent shape, a structure may be adopted in which a part of the parts having the bent shape and the end of the display panel are in direct or indirect contact with each other.

Further, it is desirable to provide a member having elasticity between the end of the display panel and the part having the bent shape. In addition, it is desirable to provide a member having elasticity between the rear of the display panel and a part that is not the part having the bent shape as well. A structure can be preferably adopted in which this member having elasticity is identical with a member having elasticity that is provided between the end of the display panel and the part having the bent shape.

In addition, various structures can be adopted as a structure for supporting the display panel. Among them, a structure can be preferably adopted in which the display panel is nipped and supported by the rear member and a member located in front of the display panel.

That is, this application includes the invention described below.

An image display device including:

a display panel for displaying an image;

a rear member located in the rear of the display panel; and a drive circuit located on the rear side of the rear member, in which the rear member has in a part thereof a part having a shape bent to the display panel side, an end of the display panel is positioned in direct or indirect contact with the part having the bent shape, and the display panel is nipped and supported by the rear member and a member located in front of the display panel.

In addition, this application also includes the invention described below.

A method of manufacturing an image display device, including the steps of:

directly or indirectly contacting an end of a display panel with a part having a shape bent to the display panel side, which is formed in a rear member that should be located in the rear of the display panel, and positioning the end of the display panel; and nipping and supporting the display panel in the positioned state by the rear member and the member that should be located in front of the display panel.

DESCRIPTION OF THE PREFERRED EMBODIMENTS

First Embodiment

Figure 1:
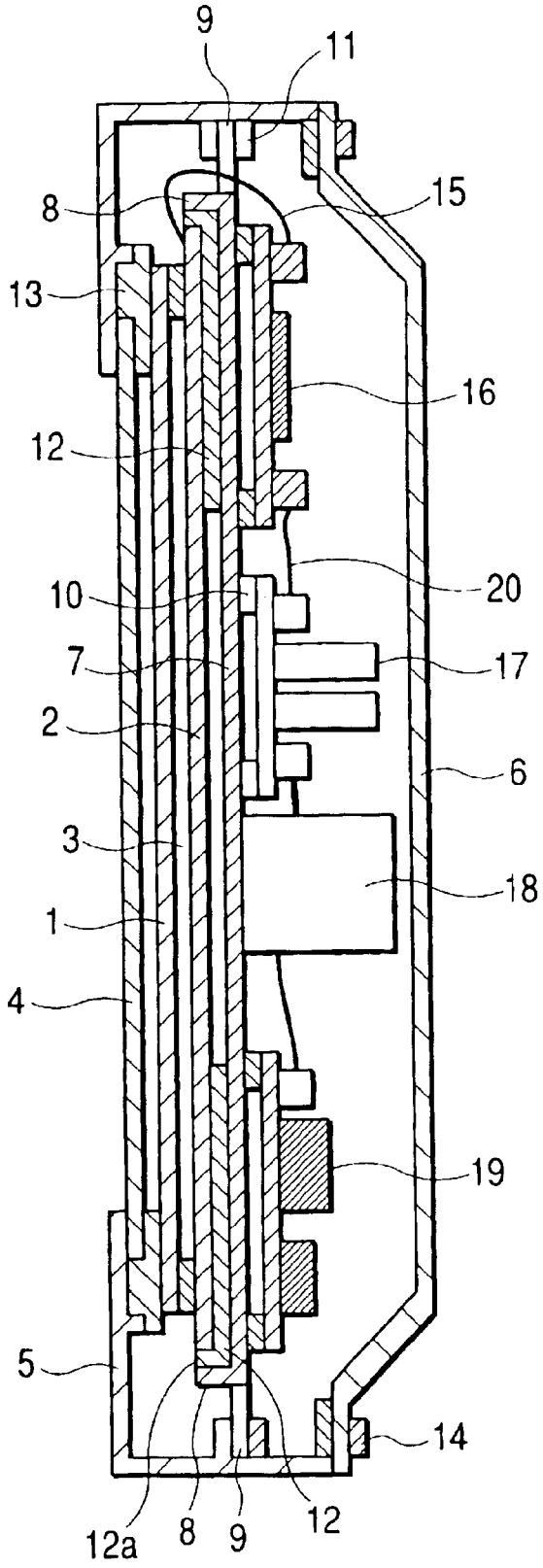
FIG. 1 is a longitudinal sectional view of an image display device in a first embodiment of the present invention.
Figure 2:
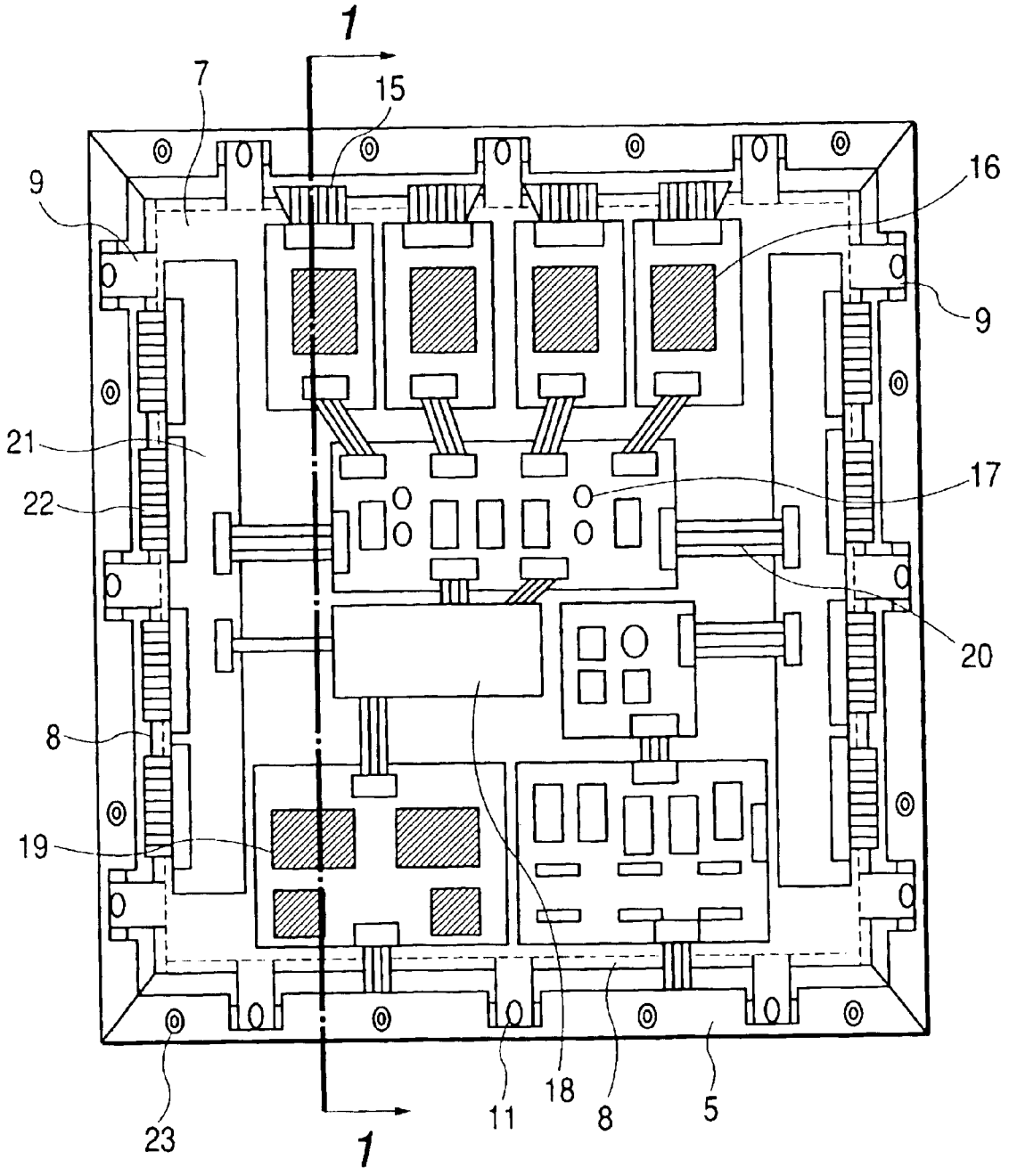
FIG. 2 is a plan view of the image display device shown in FIG. 1, from which an armor is removed, viewed from a rear side thereof.

FIG. 1 is a longitudinal sectional view of an image display device of this embodiment. FIG. 2 is a plan view of the image display device shown in FIG. 1, from which an armor is removed, viewed from a rear side thereof.

An image display unit, that is, a display panel, of the image display device of this embodiment is constituted by a faceplate 1 having a high voltage region of R, G and B phosphor films and a metal back film on a glass substrate and a rear plate 2 having X direction wirings and Y direction wirings and electron-emitting devices formed on the glass substrate. Moreover, the faceplate 1 and the rear plate 2 are attached to a frame member, thereby forming a vacuum container 3 that is maintained in vacuum.

A front plate 4 provided in front of the faceplate 1 has a function of an optical filter for improving a display characteristic, a function for controlling an electromagnetic wave generated from an internal electric circuit, and a function for protecting the vacuum container 3 from dusts and collision of objects.

A front cover 5 corresponds to a peripheral member. This front cover 5 constitutes a part of a supporting structure in the image display device of this embodiment and has a frame shape. The front cover 5 is provided for protecting the image display unit and an electric circuit unit discussed later from dusts and humidity. An aluminum alloy having electric conductivity is extruded, and then cut into a predetermined dimension to form the front cover 5, which can be recognized from the outside, in a frame shape. In addition, a rear cover 6 is also provided for preventing intrusion of dusts and foreign matter into the inside of the image display device. The rear cover 6 is constituted to be easily detached and attached by screws 14 discussed later at the time of maintenance and is manufactured by pressing of an aluminum alloy. This rear cover 6 also has rigidity and forms a part of the supporting structure in the image display device of this embodiment. The front cover 5 and the rear cover 6 are combined by the plurality of screws 14 dispersedly arranged in the perimeter of a housing consisting of the front cover 5 and the rear cover 6. In order to fix the rear cover 6 by the screws 14, female screws 23 are provided in the perimeter of the front cover 5.

A rear cushioning material 12 and a front cushioning material 13 consist of foamed urethane resin that is molded and processed. Projections 12*a* for positioning the vacuum container 3 are formed in the rear cushioning material 12. The rear cushioning material 12 is located in the rear of the vacuum container 3 and adheres to the rear plate 2 in a frame shape. In addition, the front cushioning material 13 is positioned in front of the vacuum container 3 and adheres to the faceplate 1 in a frame shape.

A plate-like member 7 functioning as a rear member is formed by pressing an aluminum alloy with a plate thickness of 2 mm. This plate-like member 7 has sufficient rigidity as a main component of the supporting structure in this embodiment. Electric circuit components mounting portions 10, which are portions bent to the rear side, for mounting electric circuits such as a power source unit 18 and a signal input circuit 19, and bent portions 8 placed in four sides in the periphery part of the plate-like member 7, respectively, are formed by the pressing. In addition, female screws for fixing (not shown) are formed in the plate-like member 7. Holes through which screws 11 pierce are formed in extended portions 9 that are portions where the bent portions 8 are not formed at the end of the plate-like member 7. The holes through which the screws 11 pierce are dispersedly arranged in the periphery of the plate-like member 7. The front cover 5 and the plate-like member 7 are coupled by the screws 11 in the parts of the holes.

Various drive circuits as described below are arranged in the rear of the plate-like member 7. A signal processing circuit 17 has a function for controlling conversion of an analog signal into a digital signal or an electric circuit system. An output signal from the signal processing circuit 17 is transmitted to Y driver circuits 16 and X driver circuits 21 discussed later via wiring 20.

The power source unit 18 generates a constant direct current voltage required for each electric circuit.

In addition, the signal input circuit 19 receives input of various signals from the outside (e.g., signals of NTSC, a video and a personal computer) and has a function for blocking an unnecessary signal.

The Y driver circuit 16 generates an electric drive signal for image display (modulation signal for modulating and driving a display device such as an electron-emitting device or an EL device provided in a display panel (a pulse width modulation signal, an amplitude modulation signal, a signal subjected to combination of pulse width modulation and amplitude modulation, or the like)) and is electrically connected to the rear plate 2 by flexible cables 15. The flexible cables 15 are connected to the Y driver circuit 16 through pluggable connectors and are connected to an electrode pattern formed on the rear plate 2 via an anisotropic conductive tape (not shown) on the one side of the rear plate 2. The electric drive signal supplied to the electrode pattern is supplied to the display device, which is driven to display an image. The flexible cables 15 are wiring for connecting the display panel and the Y driver circuit 16 functioning as a drive circuit and are drawn around through openings placed between the bent portions 8 and the front cover 5 that is a peripheral member.

The X driver circuit 21 is a circuit for sequentially supplying a scan signal to display devices driven in a matrix in the display panel. One the X driver circuit 21 is arranged in the left and the right of the image display unit, respectively. The X driver circuits 21 output the scan signal to matrix wiring of the rear plate 2 via flexible cables 22. The flexible cables 22 are connected to the X driver circuit 21 by pluggable connectors and are connected to the electrode pattern formed on the rear plate 2 via an anisotropic conductive tape (not shown) on the one side of the rear plate 2. The flexible cables 22 are wiring for connecting the display panel and the X driver circuit 21 functioning as a drive circuit and are drawn around through the openings placed between the bent portions 8 and the front cover 5 that is a peripheral member.

Next, a characteristic internal structure of the image display device of this embodiment will be described.

A structure for supporting the vacuum container 3 is a structure for nipping the vacuum container 3 by the plate-like member 7 and the front cover 5 via the rear cushioning material 12 and the front cushioning material 13, respectively. That is, the vacuum container 3 is nipped by the plate-like member 7 functioning as a rear member and the front cover 5 functioning also as a member placed in front of the display panel via the rear cushioning material 12 and the front cushioning material 13. When the screws 11 are tightened, the extended portions 9 of the plate-like member 7 adhere to the front cover 5 and the rear cushioning material 12 and the front cushioning material 13 that have elasticity support the vacuum container 3 with a large frictional force. The extended portions 9 of the plate-like member 7 are arranged in parts where the extended portions 9 do not interfere with the flexible cables 15 and 22.

In addition, in the structure for positioning the vacuum container 3, the bent portions 8 of the plate-like member 7 in the parts where the flexible cables 15 and 22 are wired surround the periphery of the vacuum container 3 with a dimension larger than the external dimension of the vacuum container 3, the rear cushioning material 12 is arranged in a frame shape on the inner side of the bent portions 8, and the end of the rear plate 2 is positioned over the entire circumference thereof by the projections 12*a* of the rear cushioning material 12. In this embodiment, all of the plurality of bent portions 8 arranged on the four sides in the periphery part of the plate-like member 7 come into contact with the end of the rear plate 2 which corresponds the end of the display panel, via the cushioning materials to position the rear plate 2.

Here, principle of an operation of the thin flat image display unit of the image display device of this embodiment will be described.

This image display unit uses electron-emitting devices. In particular, surface conduction electron-emitting devices are used as the electron-emitting devices. A voltage of more than ten volts is applied to between selected X direction wiring and Y direction wiring in an electric mount circuit to emit electrons from the electron-emitting devices of the rear plate 2. The emitted electrons are accelerated by a positive potential of more than ten kilovolts, which is supplied to the metal back film on the vacuum gap side of the faceplate 1 from an external high voltage power source, and collide with the phosphor films to emit light. The flexible cables connecting the rear plate 2 and the electric mount circuit are electrically and mechanically connected by connectors on the electric mount circuit side thereof. On the other hand, the flexible cables are electrically and mechanically connected to electrode portions (ends of wiring) in the X direction wiring and the Y direction wiring printed on the rear plate 2 by the anisotropic conductive film on the rear plate 2 side thereof. High voltage cables connecting the metal back film of the faceplate 1 and a high voltage power source circuit are electrically and mechanically connected by connectors for a high voltage on the high voltage power source circuit side thereof. On the other hand, the high voltage cables are electrically and mechanically connected to the metal back film via high voltage terminals arranged in through holes provided in the rear plate 2 (see Japanese Patent Application Laid-Open No. 07-235255 for details).

Next, a process for manufacturing the image display device of this embodiment with the structure as described above will be described with reference to FIGS. 3A to 3C and FIGS. 4A and 4B.

Figure 3A:
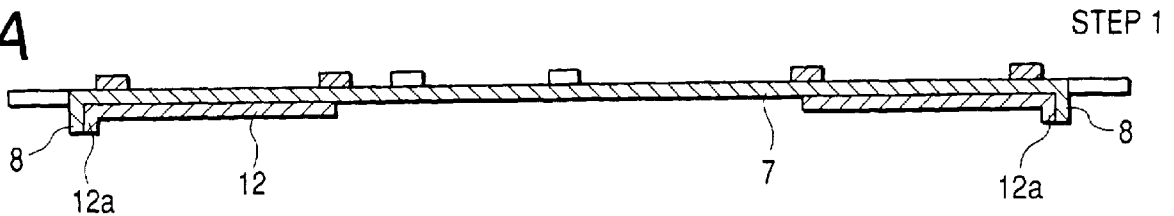
FIGS. 3A, 3B and 3C are views for explaining a process for manufacturing the image display device in the first embodiment of the present invention.

First, as step 1, the rear cushioning material 12 is arranged in a frame shape so as to fit along the bent portions 8 in the peripheral part of the plate-like member 7 (FIG. 3A).

Figure 3B:
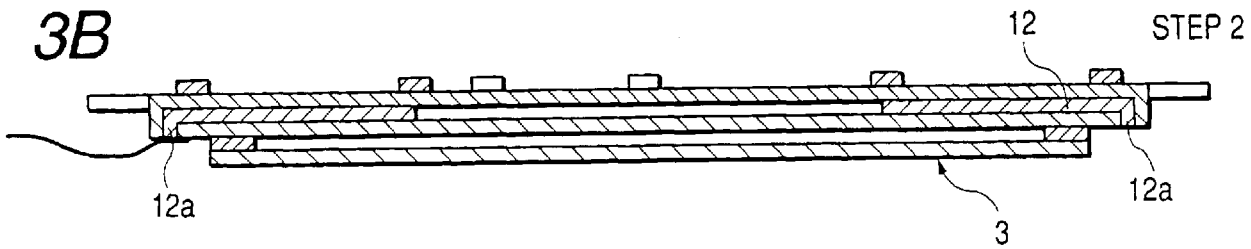

Next, as step 2, the vacuum container 3 is positioned by the projections 12*a* of the rear cushioning material 12 and fitted in (FIG. 3B).

Figure 3C:
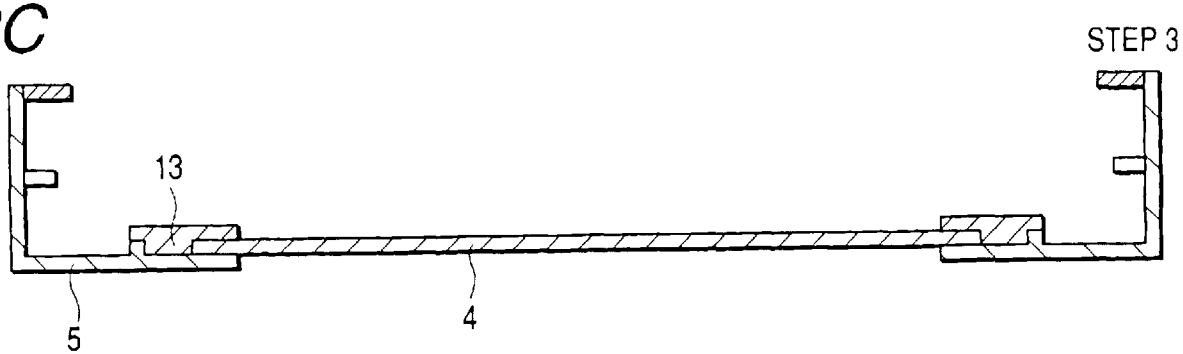

Next, as step 3, the front cover 5 and the front plate 4 are joined and the front cushioning material 13 is arranged in a frame shape, whereby the front cover 5 and the front plate 4 are integrated (FIG. 3C).

Figure 4A:
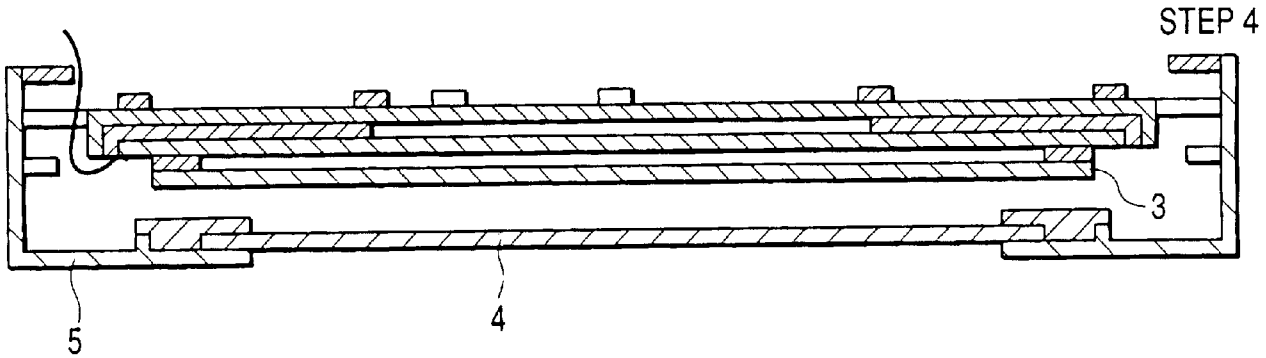
FIGS. 4A and 4B are views for explaining a process for manufacturing the image display device in the first embodiment of the present invention.

Next, as step 4, the integrated front cover 5 and front plate 4 are covered over the vacuum container 3 from the front thereof (FIG. 4A).

Figure 4B:
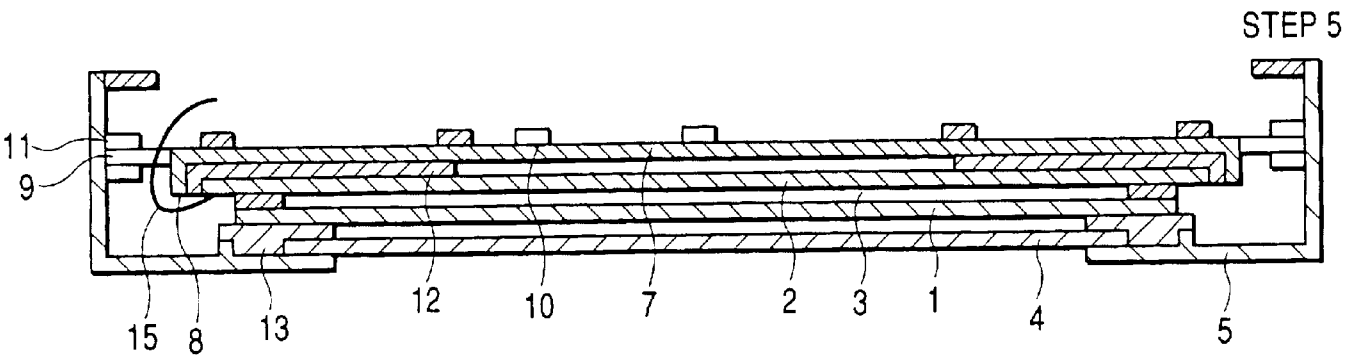

Next, as step 5, the screws 11 are pierced through the extended portions 9 of the plate-like member 7, inserted in the female screws (not shown) of the front cover 5 and tightened, whereby the vacuum container 3 is nipped and supported by the plate-like member 7 and the front cover 5 (FIG. 4B). Then, after fixing electric components such as the Y driver circuit 16 to the electric circuit components mounting portions 10 using screws (not shown), wiring is carried out, and finally the rear cover 6 is placed and fixed by the screws 14 to complete the assembly of the image display device of this embodiment.

As described above, in the image display device of this embodiment, the rear cushioning material 12 is provided so as to fit along the bent portions 8 of the plate-like member 7 and the vacuum container 3 is positioned by the projections 12*a*, whereby positioning becomes easy. In addition, since the positioning of the vacuum container 3 by the projections 12*a* is performed in the periphery of the vacuum container 3, deviation of the display screen can be prevented over a long period of time and reliability can be improved. Moreover, since the vacuum container 3 is supported by a frictional force of the rear cushioning material 12 and the front cushioning material 13 by tightening the screws 11, even if assembly should fail, repair can be easily performed. Thus, it is possible to improve yield and at the same time, recycling can be simplified to reduce recycling costs.

Second Embodiment

Figure 5:
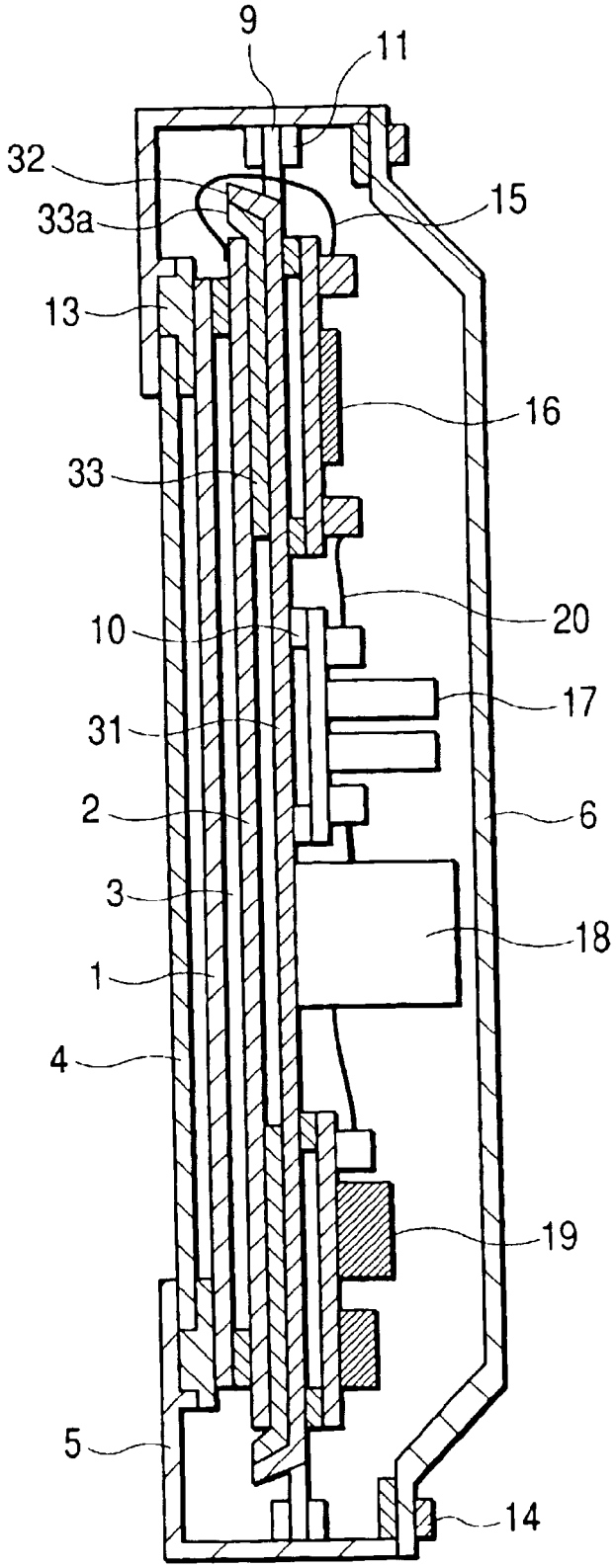
FIG. 5 is a longitudinal sectional view of an image display device in a second embodiment of the present invention.
Figure 6:
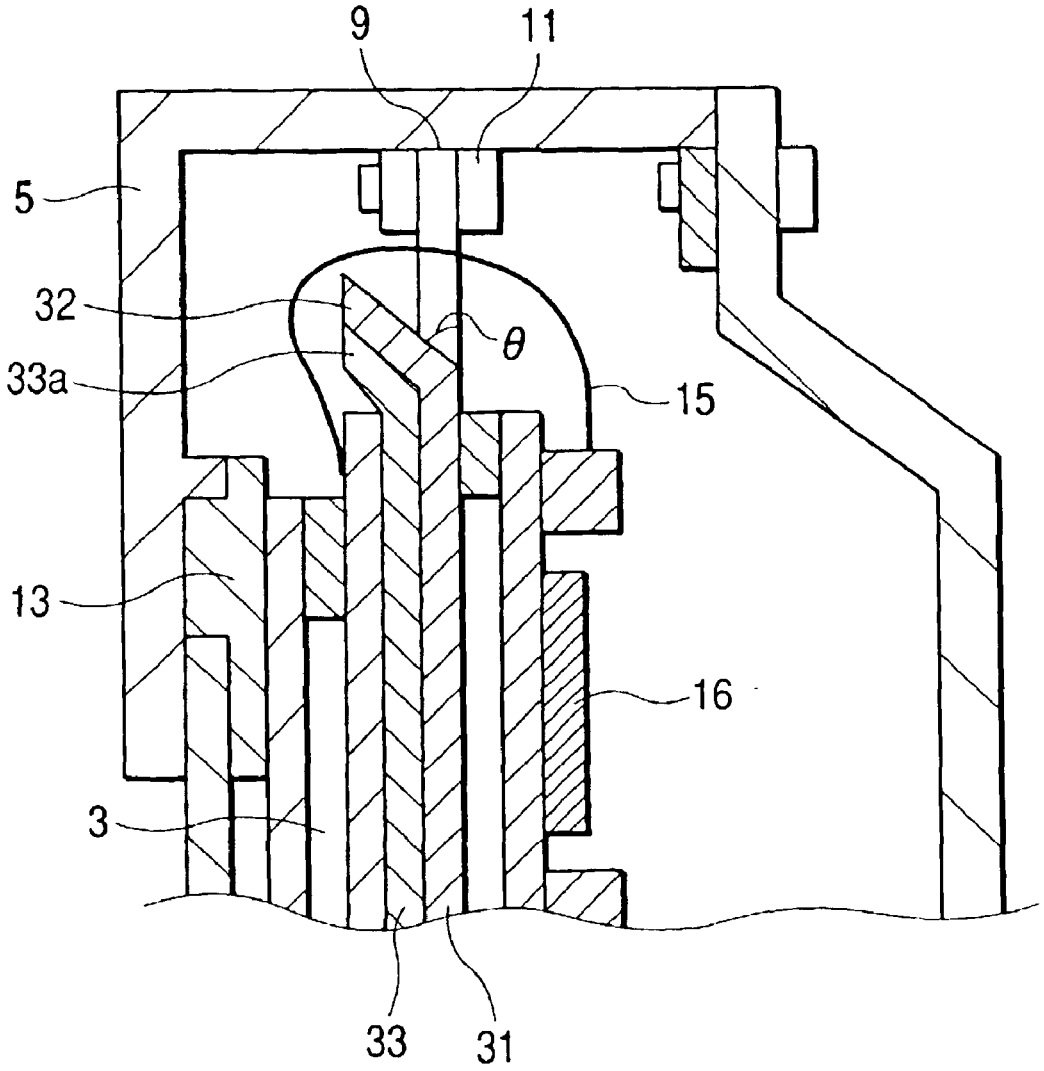
FIG. 6 is a longitudinal sectional view of an enlarged main part of the image display device shown in FIG. 5.

FIG. 5 is a longitudinal sectional view of an image display device of this embodiment. FIG. 6 is a longitudinal sectional view of an enlarged main part of the image display device shown in FIG. 5. Note that the same members as those in the first embodiment are denoted by the identical reference numerals and the members will not be described.

A plate-like member 31 is a member having rigidity for supporting the vacuum container 3 and is formed by pressing an aluminum alloy with a plate thickness of 2 mm into a predetermined shape. The plate-like member 31 is arranged in a position covering the entire surface on the rear side of the vacuum container 3.

Bent portions 32 placed on the outside of the external circumference of the vacuum container 3 are provided in the periphery of the plate-like member 31. Flexible cables 15 are wired utilizing spaces of the front cover 5 opposed to the bent portions 32. The bent portions 32 are integrally formed with the plate-like member 31 when the plate-like member 31 is pressed.

A rear cushioning material 33 is formed by molding foamed urethane resin into a predetermined shape and is arranged in a frame shape along the inner side of bending of the bent portions 32. The rear cushioning material 33 adheres to the rear plate 2 on the rear side of the vacuum container 3. In addition, projections 33*a* of the rear cushioning material 33 form substantially the same angle as a bending angle θ of the bent portions 32 of the plate-like frame 31, and bases thereof are approximate to the external dimension of the rear plate 2. However, tips of the projections 33*a* are larger than the external dimension of the rear plate 2 by several millimeters. Note that the angle θ of the bent portions 32 may be any angle as long as it is 900 or less and the bent portions 32 have a bent shape.

Next, a characteristic structure of this embodiment will be described.

A structure for supporting the vacuum container 3 is a structure for nipping the vacuum container 3 by the plate-like member 31 and the front cover 5 via the rear cushioning material 33 and the front cushioning material 13. When the screws 11 are tightened, the extended portions 9 of the plate-like member 31 adhere to the front cover 5 and the rear cushioning material 33 and the front cushioning material 13 that have elasticity support the vacuum container 3 with a large frictional force. The extended portions 9 of the plate-like member 31 are arranged in parts where the flexible cables 15 and 22 are not wired. In addition, the bent portions 32 of the plate-like member 31 in the parts where the flexible cables 15 and 22 are wired surround the periphery of the vacuum container 3 with a dimension larger than the external dimension of the vacuum container 3, the rear cushioning material 33 is arranged in a frame shape on the inner side of the bent portions 32, and each end of the four sides of the rear plate 2 is in contact with the bent portions 32 via the projections 33*a* of the rear cushioning material 33. The display panel is positioned by this contact. As described above, a shape of the projections 33*a* of the rear cushioning material 33 forms substantially the same angle as the bending angle θ of the bent portions 32 of the plate-like member 31, and the bases thereof are approximate to the external dimension of the rear plate 2 but the tips of the projections 33*a* are larger than the external dimension of the rear plate 2 by several millimeters. That is, since the bent portions 32 and the projections 33*a* are open with respect to an attachment direction of the vacuum container 3, the vacuum container 3 is easily introduced into the bent portions 32. Thus, in a manufacturing process for arranging the display panel to the rear cushioning material 33, accurate positioning is unnecessary. Since the vacuum container 3 fits into the bases of the projections 33*a* of the rear cushioning material 33 after the front cover 5 is tightened by the screws 11 via the front cushioning material 13, an accurate position is set.

As described above, in the image display device of this embodiment, as in the first embodiment, the rear cushioning material 33 is provided so as to fit along the bent portions 32 of the plate-like member 31 and the vacuum container 3 is positioned by the bent portions 32 via the projections 33*a*, whereby positioning becomes easy. In addition, since the positioning of the vacuum container 3 by the projections 33*a* is performed in the periphery of the vacuum container 3, deviation of the display screen can be prevented over a long period of time and reliability can be improved. Moreover, since the vacuum container 3 is supported by a frictional force of the rear cushioning material 33 and the front cushioning material 13 by tightening the screws 11, even if assembly should fail, repair can be easily performed. Thus, it is possible to improve yield and at the same time, recycling can be simplified to reduce recycling costs.

In addition, in the case of the image display device of this embodiment, since the tips of the projections 33*a* are made larger than the external dimension of the rear plate 2 by several millimeters, accurate positioning is unnecessary when the vacuum container 3 is arranged in the rear cushioning material 33, and positioning becomes easy.

In each embodiment described above, the display panel is positioned in the bent portions of the plate-like member once, and thereafter the display panel positioned and held in the plate-like member is nipped and supported by the peripheral members. Consequently, a structure for optically and electrically positioning the display panel, which is necessary in adhering and fixing the display panel to the frame while positioning the same, becomes unnecessary. In addition, time required for positioning work is also reduced.

Further, since the display panel is positioned in the periphery thereof, deviation of the display screen can be prevented over a long period of time.

The specific embodiments have been described above and the invention pertaining to this application can implement various forms other than these embodiments.

What is claimed is:

1. An image display device comprising:

a display panel for displaying an image;

a rear member that is located in the rear of said display panel; and a drive circuit that is located on the rear side of said rear member, wherein said rear member has in a part thereof a part having a shape bent to said display panel side, said display panel and said drive circuit are connected by wiring passing through an opening that is located adjacent to the part having said bent shape, and a positional deviation of said display panel is regulated by the part having said bent shape.

2. An image display device according to claim 1, wherein the part having said bent shape is provided in a part of the end of said rear member.

3. An image display device according to claim 1, wherein said bent shape is a shape formed by bending.

4. An image display device according to claim 2, wherein said bent shape is a shape formed by bending.

5. An image display device according to claim 1, wherein a part to be said opening is simultaneously formed by forming the part having said bent shape.

6. An image display device according to claim 2, wherein a part to be said opening is simultaneously formed by forming the part having said bent shape.

7. An image display device according to claim 3, wherein a part to be said opening is simultaneously formed by forming the part having said bent shape.

8. An image display device according to claim 4, wherein a part to be said opening is simultaneously formed by forming the part having said bent shape.

9. An image display device according to claim 1, further comprising peripheral members placed in the periphery of said rear member, wherein said rear member is coupled with said peripheral members in parts other than the part having said bent shape.

10. An image display device according to claim 2, further comprising peripheral members placed in the periphery of said rear member, wherein said rear member is coupled with said peripheral members in parts other than the part having said bent shape.

11. An image display device according to claim 3, further comprising peripheral members placed in the periphery of said rear member, wherein said rear member is coupled with said peripheral members in parts other than the part having said bent shape.

12. An image display device according to claim 4, further comprising peripheral members placed in the periphery of said rear member, wherein said rear member is coupled with said peripheral members in parts other than the part having said bent shape.

13. An image display device according to claim 5, further comprising peripheral members placed in the periphery of said rear member, wherein said rear member is coupled with said peripheral members in parts other than the part having said bent shape.

14. An image display device according to claim 6, further comprising peripheral members placed in the periphery of said rear member, wherein said rear member is coupled with said peripheral members in parts other than the part having said bent shape.

15. An image display device according to claim 7, further comprising peripheral members placed in the periphery of said rear member, wherein said rear member is coupled with said peripheral members in parts other than the part having said bent shape.

16. An image display device according to claim 8, further comprising peripheral members placed in the periphery of said rear member, wherein said rear member is coupled with said peripheral members in parts other than the part having said bent shape.

17. An image display device according to claim 1, wherein said display panel is positioned by the end thereof directly or indirectly coming into contact with the part having said bent shape.

18. An image display device according to claim 2, wherein said display panel is positioned by the end thereof directly or indirectly coming into contact with the part having said bent shape.

19. An image display device according to claim 3, wherein said display panel is positioned by the end thereof directly or indirectly coming into contact with the part having said bent shape.

20. An image display device according to claim 4, wherein said display panel is positioned by the end thereof directly or indirectly coming into contact with the part having said bent shape.

21. An image display device according to claim 5, wherein said display panel is positioned by the end thereof directly or indirectly coming into contact with the part having said bent shape.

22. An image display device according to claim 6, wherein said display panel is positioned by the end thereof directly or indirectly coming into contact with the part having said bent shape.

23. An image display device according to claim 7, wherein said display panel is positioned by the end thereof directly or indirectly coming into contact with the part having said bent shape.

24. An image display device according to claim 8, wherein said display panel is positioned by the end thereof directly or indirectly coming into contact with the part having said bent shape.

25. An image display device according to claim 9, wherein said display panel is positioned by the end thereof directly or indirectly coming into contact with the part having said bent shape.

26. An image display device according to claim 10, wherein said display panel is positioned by the end thereof directly or indirectly coming into contact with the part having said bent shape.

27. An image display device according to claim 11, wherein said display panel is positioned by the end thereof directly or indirectly coming into contact with the part having said bent shape.

28. An image display device according to claim 12, wherein said display panel is positioned by the end thereof directly or indirectly coming into contact with the part having said bent shape.

29. An image display device according to claim 13, wherein said display panel is positioned by the end thereof directly or indirectly coming into contact with the part having said bent shape.

30. An image display device according to claim 14, wherein said display panel is positioned by the end thereof directly or indirectly coming into contact with the part having said bent shape.

31. An image display device according to claim 15, wherein said display panel is positioned by the end thereof directly or indirectly coming into contact with the part having said bent shape.

32. An image display device according to claim 16, wherein said display panel is positioned by the end thereof directly or indirectly coming into contact with the part having said bent shape.

33. An image display device according to any one of claims 1 to 32, wherein said display panel is nipped and supported by said rear member and a member placed in front of said display panel.

34. An image display device comprising:

a display panel for displaying an image;

a rear member located in the rear of said display panel; and a drive circuit located on the rear side of said rear member, wherein said rear member has in a part thereof a part having a shape bent to said display panel side, an end of said display panel is positioned in direct or indirect contact with the part having said bent shape, and said display panel is nipped and supported by said rear member and a member located in front of said display panel.

35. A method of manufacturing an image display device, comprising the steps of:

directly or indirectly contacting an end of a display panel with a part having a shape bent to said display panel side, which is formed in a rear member that should be located in the rear of said display panel, and positioning the end of said display panel; and nipping and supporting said display panel in the positioned state by said rear member and the member that should be located in front of said display panel.

* * * * *